United States Patent [19]

Brown

[11] 4,423,979

[45] Jan. 3, 1984

[54] EXPANSION JOINT SEALING STRUCTURES

[75] Inventor: Delmont D. Brown, North Baltimore, Ohio

[73] Assignee: The D. S. Brown Company, North Baltimore, Ohio

[21] Appl. No.: 285,476

[22] Filed: Jul. 21, 1981

Related U.S. Application Data

[63] Continuation-in-part of Ser. No. 76,908, Sep. 19, 1979, Pat. No. 4,290,713.

[51] Int. Cl.[3] ..... E01C 11/02

[52] U.S. Cl. ..... 404/69; 404/47; 52/396; 49/475

[58] Field of Search ..... 404/69, 68, 65, 64, 404/47; 52/396; 49/475

[56] References Cited

U.S. PATENT DOCUMENTS

| | | | |
|---|---|---|---|
| 3,276,335 | 10/1966 | Middlestadt | 404/48 |
| 3,324,774 | 6/1967 | Boschi | 404/47 |
| 3,363,383 | 1/1968 | La Barge | 404/65 X |
| 3,555,981 | 1/1971 | Vitali | 404/65 X |
| 3,732,021 | 5/1973 | Rizza | 14/16.5 X |
| 3,824,025 | 7/1974 | Beutler | 404/68 X |
| 3,888,599 | 6/1975 | Reifsnyder | 404/69 |
| 4,067,660 | 1/1978 | Puccio | 404/65 X |
| 4,290,713 | 9/1981 | Brown | 404/59 |

*Primary Examiner*—Nile C. Byers, Jr.
*Attorney, Agent, or Firm*—Keil & Witherspoon

[57] ABSTRACT

Expansion and cast-in retainer dams for sealing pavement joints against intrusion of water, dirt, etc., into the joint space, said dams utilizing a pair of extruded steel or aluminum frames on opposite sides of the joint and a continuous elastomer strip spanning the joint and interlocked along its opposite edges in slotted longitudinal openings in the frames by a bead of triangular cross-section on each edge of the strip, the frames each having elongated solid metal zones above and below the slotted openings.

4 Claims, 3 Drawing Figures

EXPANSION JOINT SEALING STRUCTURES

RELATED APPLICATION

This application is a continuation-in-part of application Ser. No. 076,908, filed Sept. 19, 1979, now U.S. Pat. No. 4,290,713, issued Sept. 22, 1981 by Delmont D. Brown and Michael C. Rizza.

THE IMPROVEMENTS HEREIN

This application differs principally from the issued patent in the side frames for the dam. In the present case they are made as steel (or less preferably aluminum) extrusions with solid metal zones in lieu of the hollow zones found in the rolled steel frames of the dams of the issued patent. The solid metal zones are found above and below the longitudinal slot which receives the longitudinal bead of the elastomer strip positioned between opposing side frames and spanning the joint.

BACKGROUND OF THE INVENTION AND PRIOR ART

There have been many structures proposed for sealing joints in roadway pavements, bridge pavements and the like. The objective is to prevent water and solid foreign substances from penetrating the space, called a joint, between adjacent sections of concrete pavement—such spaces being provided to accomodate the expansion of the respective concrete pavement sections during warm and hot weather and contraction thereof in cold weather.

Same sealing structures previously used include elastomer extrusions of various external and internal geometric configuration while others use a combination of metal frames, beams or the like with elastomer members between the frames, beams, etc. to provide the sealing function and at the same time accomodating the changes in the joint width as the concrete expands and contracts during climatic temperature changes.

THE INVENTION

The subject invention constitutes improvements in joint sealing structures commonly referred to as expansion dams or expansion joint seals. The sealing structures utilize a pair of elongated extruded steel (or less preferably aluminum) frames respectively extending along opposite sides of the joint. Preferably they are substantially flush with the surface of the pavement and do not protrude in the vertical plane beyond the opposed faces of the spaced concrete sections at the joint.

The extruded frames are metal extrusions, preferably of ordinary or stainless steel. The top, rear and bottom walls are substantially flat (planar); the corners preferably are rounded. The fourth front wall or face is situated on the joint side and has an upper portion and a lower portion forming a longitudinal slot in which the longitudinal edges of an elastomer sealing strip are interlocked.

The upper portion is solid metal with a rearwardly, diagonally sloping front wall which extends toward but stops short of the rear wall of the frame. The lower portion is also solid metal and has a curved front wall or a short straight front wall segment parallel with the rear wall and an upper, sharp bend between it and an upper, diagonal edge segment which is substantially parallel with the diagonal front wall of the upper portion.

In either case, the longitudinal opening or the short passage between the diagonal front wall and diagonal edge segment and forming the longitudinal slot has a pair of spaced, longitudinal shoulders used to interlock the longitudinal lips of the elastomer sealing strip in the respective frames.

The sealing strip is an elongated extrusion of weather resistant synthetic rubber, preferably neoprene. In cross-section, it has a V-shape which becomes a deeper or shallower V as the joint narrows or widens under temperature changes. Its respective longitudinal edges comprise a strip forming a neck which is preferably the same width as or slightly wider than the width of the slot in the frames. At the outer end of each neck is a bead of triangular transverse cross section. The neck is attached to the mid-portion of one of the sides of the triangle—thereby forming lips or shoulders which lock the triangular bead inside the extruded metal frame after the bead has been forced through the above-described opening or slot in each frame.

PREFERRED EMBODIMENTS

Preferred embodiments of the invention are illustrated in the drawings, wherein:

IN THE DRAWINGS

Figure 1:
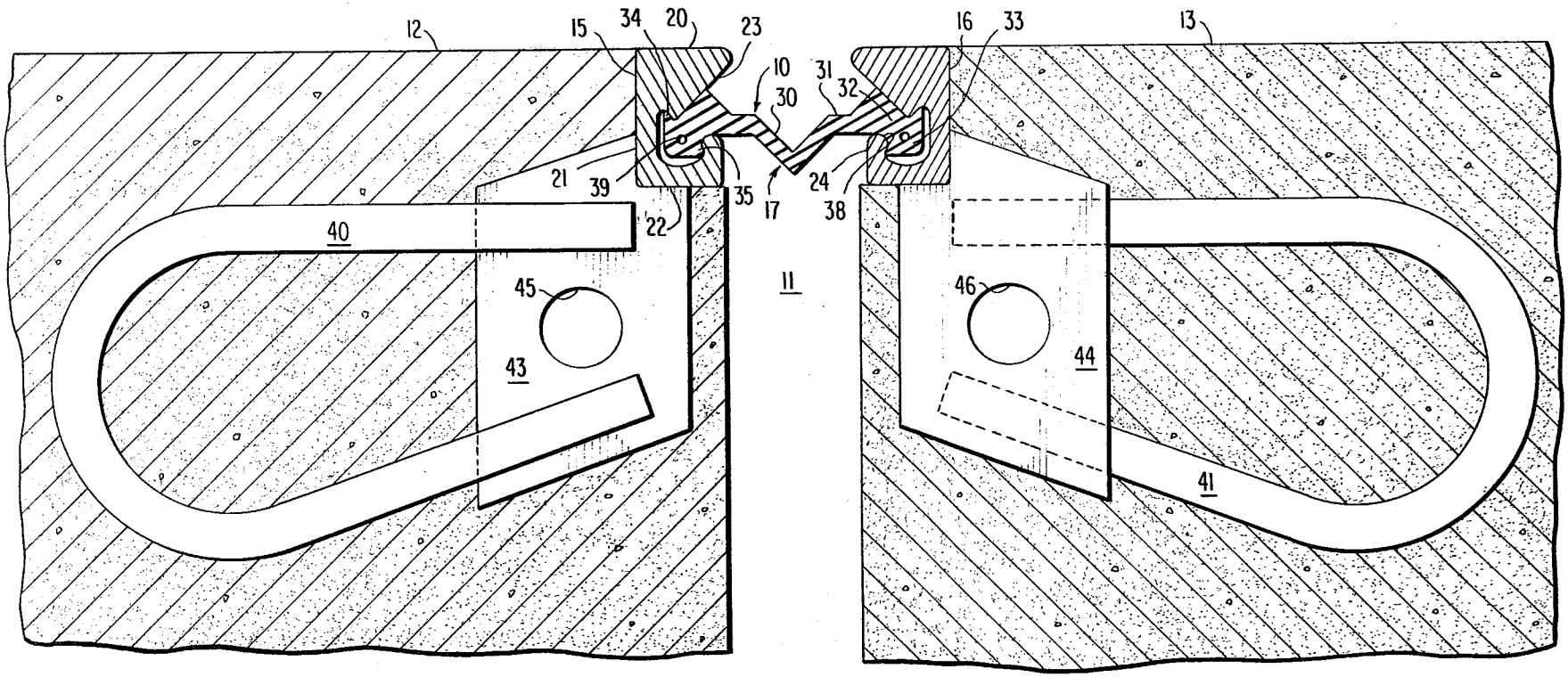
FIG. 1 is a cross-section view of two pavement sections with a joint therebetween, the latter being sealed by a first embodiment of an expansion dam of the invention.

Referring to the drawings, the expansion dam 10 of FIG. 1 seals the space or joint 11 provided between adjacent pavement sections 12 and 13 and having a width sufficient to allow the pavement sections to expand without coming into abutting contact. The expansion dam is composed of an elongated first retainer section or frame 15 on one side of the joint and a second elongated retainer section or frame 16 on the other side of the joint. An elongated neoprene elastomer strip 17 spans the joint and seals it against intrusion by water, dirt, stones and other foreign substances.

The respective metal frames are shaped into the cross-sections shown by known metal extrusion techniques. Each section has a top wall 20, rear wall 21, bottom wall 22, a solid metal lower segment 24 in the front wall and solid metal upper segment with a downwardly and rearwardly sloping front wall, i.e., segment 23.

The upper and lower segments are separated in a manner forming an elongated, longitudinal slot into which the respective longitudinal edges of the elastomer strip are inserted and locked. The elastomer strip 17 comprises a center, V-section 30 which becomes deeper or shallower as the joint narrows or widens. The V-section is connected by respective narrow strips 31 to respective necks 32. An elongated bead 33 of triangular cross-section is connected at the mid-portion of one of its sides to the neck. One or more longitudinal passages 38 and 39 may be provided in the triangular bead portion to increase the deformability thereof.

The neck 32 has a width substantially the same as the distance between the longitudinal lip 35 of the transversely curved front wall of the lower portion 24 and the surface of the diagonally sloping front wall of the upper segment 23. The triangular bead 33 is sufficiently deformable so that it can be forced through the elongated slot—the passages 38 and 39 aiding the deformability as the bead 33 is forced through the slot.

The beads 33 in seated position in the slots are shown in FIG. 1. The longitudinal lips 34 and 35 on each side of the neck 32 seal against the edge of the upper segment 23 and the inside surface of the transversely curved lower portion to lock the longitudinal edges of the elastomer sealing strip 17 in the sections or frames 15 and 16.

The latter may be mounted in the pavement sections by any suitable means, e.g., by using at spaced intervals loop anchor bars 40 and 41 embedded in the pavement and in turn welded to vertical plates 43 and 44. The latter in turn are fixedly connected to the frames or sections 15 and 16. The plates optionally may have holes 45 and 46 adapted to receive steel anchor bars used in the overall joint assembly.

Figure 2:
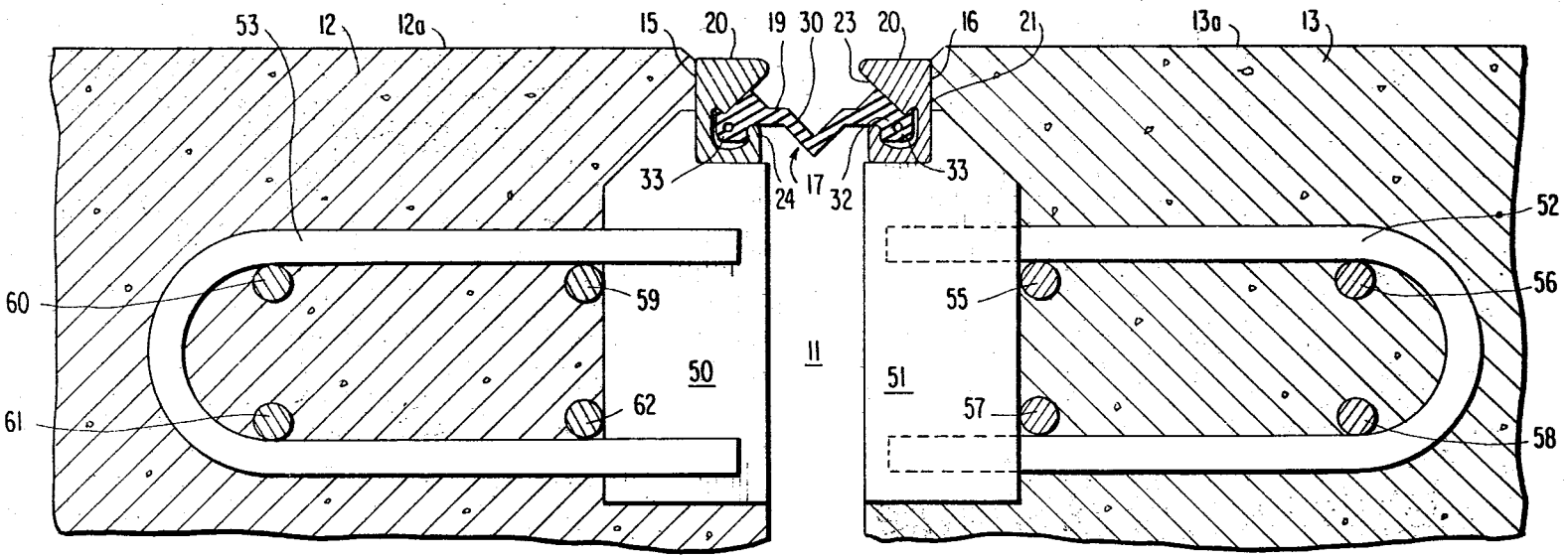
FIG. 2 is a section view similar to FIG. 1, with a different structure for mounting each frame in the pavement.

The embodiment of FIG. 2 is similar to that of FIG. 1. Where applicable, like numerals designate like parts. Whereas the top walls 20 of the frames or sections 15 and 16 are flush with the pavement surface, the top walls 20 in FIG. 2 are recessed slightly below the pavement surfaces 12*a* and 13*a*. Further, the frames or sections 15 and 16 are mounted in place by attachment thereof at longitudinal intervals to vertical plates 50 and 51. The latter are each welded to a loop anchor. Each loop anchor 52, 53 in turn is supported by steel bars 55–62.

Figure 3:
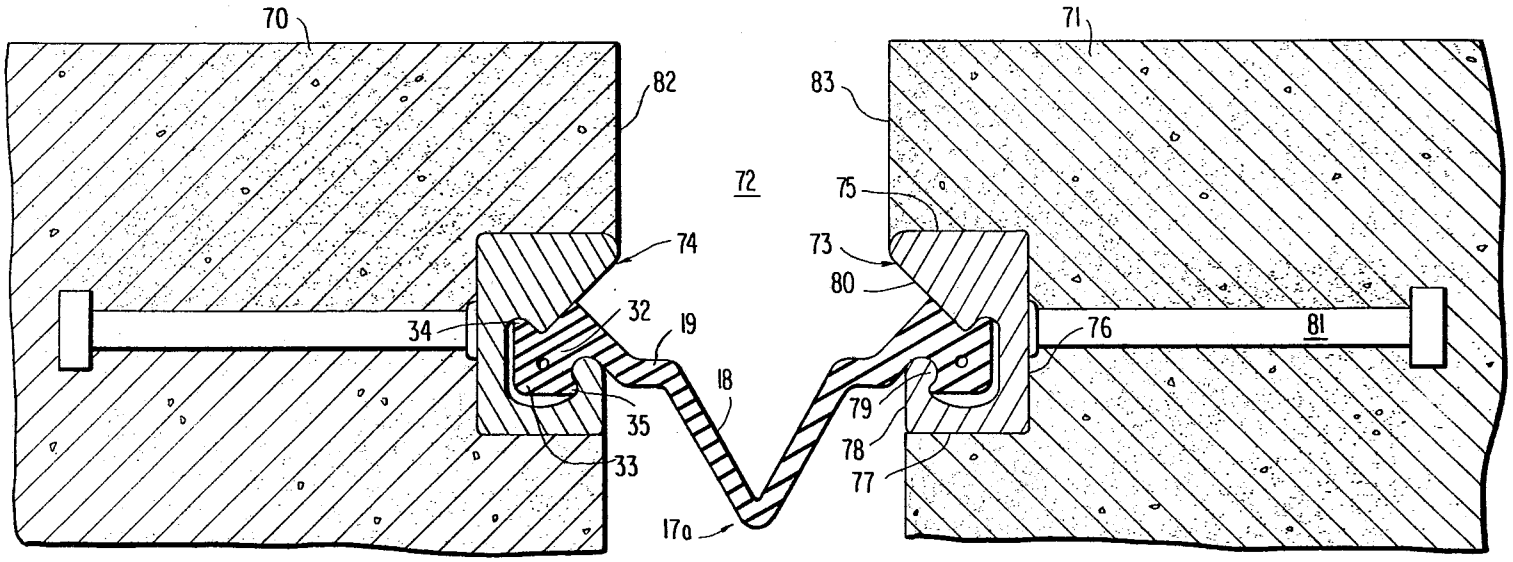
FIG. 3 is a cross-section view of two pavement sections with a cast-in retainer strip seal.

The embodiment of FIG. 3 is a cast-in retainer strip seal in which the joint 72 between pavement sections 70 and 71 is sealed by a similar elastomer strip 17*a* having a medial V-section 18. The latter is recessed well below the upper surface of the pavement sections. The strip-gripping elongated frames or sections 73 and 74 have a top wall 75, a rear wall 76, a bottom wall 77, and a front wall. The front wall has two segments—a solid metal lower segment 78 terminating with a downwardly and rearwardly sloping lip 79, and a solid metal upper segment 80 with a rearwardly sloping front wall. The frames or sections 73 and 74 are held in place in the pavement with the front wall being substantially flush with the respective face 82 and 83 by anchors 81.

The elastomer seal 17*a* is mounted in the frames or sections 73, 74 by forcing each deformable triangular bead 33 through its continuous longitudinal slot formed between and below the segment 80 and the lip 79. The lips 34 and 35 lock the respective longitudinal edges in place as shown in FIG. 3. Flexible neck portions 19 connect the V-segment 18 with necks 32.

I claim:

1. An expansion joint between adjacent pavement sections with an elastomer seal comprising a first metal frame mounted on and extending along one side of said joint, an opposing second metal frame mounted on and extending along the other side of said joint, and an elastomer sealing strip spanning the joint and having longitudinal edges each extending in an outward and downward direction and having a neck portion with a distortable point of substantially triangular cross section, by means of which said longitudinal edge is seated, in interlocking relationship in its respective frame, each said frame being of solid extruded metal forming a front wall, facing the opposite frame, which includes an upper and lower segment with slanted surfaces defining an outwardly and downwardly extending slot widening into a cavity, said slanted surface of the upper segment terminating in a shoulder defining part of said cavity, and the upper surface of the neck portion of said elastomer strip having an elongated neck surface which is slanted the same as the slanted surface of the upper segment and which, upon insertion of the distortable point of the longitudinal edge of the strip into its respective frame engages the slanted surface of the upper segment, in cooperation with said lower segment, while the base of said triangular point bears against said shoulder so as to prohibit withdrawal therefrom and to hold said elastomer strip securely in position.

2. An expansion joint as claimed in claim 1 wherein the central portion of said elastomer seal is a V-shaped segment.

3. An expansion joint as claimed in claim 1, wherein each frame has a top wall substantially flush with the surface of the pavement, and said frames being mounted on their respective pavement section by vertical plates attached at longitudinal intervals to said frames.

4. An expansion joint as claimed in claim 3, wherein each plate has attached thereto an anchor bar which is buried in the pavement.

* * * * *